United States Patent [19]

Schwartz

[11] Patent Number: 4,691,923

[45] Date of Patent: Sep. 8, 1987

[54] GOLF GAME APPARATUS

[76] Inventor: Walter Schwartz, 680 Bardal Bay, Winnipeg, Manitoba, Canada, R2G 0J2

[21] Appl. No.: 842,229

[22] Filed: Mar. 21, 1986

[30] Foreign Application Priority Data

Mar. 29, 1985 [CA] Canada ..... 477962

[51] Int. Cl.[4] ..... A63B 69/36

[52] U.S. Cl. ..... 273/180; 273/127 B; 273/176 B

[58] Field of Search ..... 273/180, 352, 178 R, 273/179 R, 123 R, 127 R, 402, 127 B, 176 F, 176 B

[56] References Cited

U.S. PATENT DOCUMENTS

| | | | |
|---|---|---|---|
| D. 77,020 | 11/1928 | Meilicke | 273/180 |
| 1,687,217 | 10/1928 | Kurtz | 273/180 X |
| 1,952,187 | 3/1934 | Wade | 273/180 |
| 2,704,212 | 3/1955 | Dunseith | 273/352 X |
| 2,810,580 | 10/1957 | Johnson | 273/180 |
| 3,275,325 | 9/1966 | MacKenzie | 273/180 X |
| 3,817,535 | 6/1974 | Doughty | 273/180 |
| 3,876,210 | 4/1975 | Brandell | 273/180 |

FOREIGN PATENT DOCUMENTS

| | | | |
|---|---|---|---|
| 291535 | 6/1928 | United Kingdom | 273/180 |

*Primary Examiner*—George J. Marlo

*Attorney, Agent, or Firm*—Stanley G. Ade; Adrian D. Battison

[57] ABSTRACT

A ramp guided by a pair of side rails is apertured to receive a golf ball putted from approximately 5 to 15 feet away so that various scores can be obtained and a golf game may be simulated. The apertures are so positioned that apart from the front row of apertures, the remainder may only be reached by the golf ball via a very narrow path because the apertures act as traps for one another defining the narrow path. The game is portable and can be played on any reasonably flat surface.

2 Claims, 4 Drawing Figures

GOLF GAME APPARATUS

BACKGROUND OF THE INVENTION

This invention relates to new and useful improvements in what are termed "carpet games" although they may of course be played on any reasonably flat or planar surface.

The game is primarily a carpet golf game which can be played by young, old or handicapped persons. It may be played indoors or outdoors and, as mentioned previously, on a carpet or any suitable surface.

As will become apparent, the game may be played in any one of two ways. First it may be played by numbers or certainly as a game of golf.

SUMMARY OF THE INVENTION

One of the advantages of the invention is that the extending side rails may be folded rearwardly thus reducing the overall size of the device for storage or transportation purposes.

One aspect of the invention includes a ball receiver for use in playing a game of carpet golf or the like on a substantially planar surface and comprising in combination a multi-apertured ramp board, a surrounding frame consisting of a side member along each side of the board defining an open front entrance to said board and means at the rear of said side members closing off the rear side of the board, said side members and said means at the rear thereof extending above the plane of the board, and a further aperture at the rear of the board defined by the rear edge thereof and the means at the rear of the side members.

Another advantage of the invention is that the device is simple in construction, economical in manufacture and otherwise well suited to the purpose for which it is designed inasmuch as it presents a challenging game simulating a golf game.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
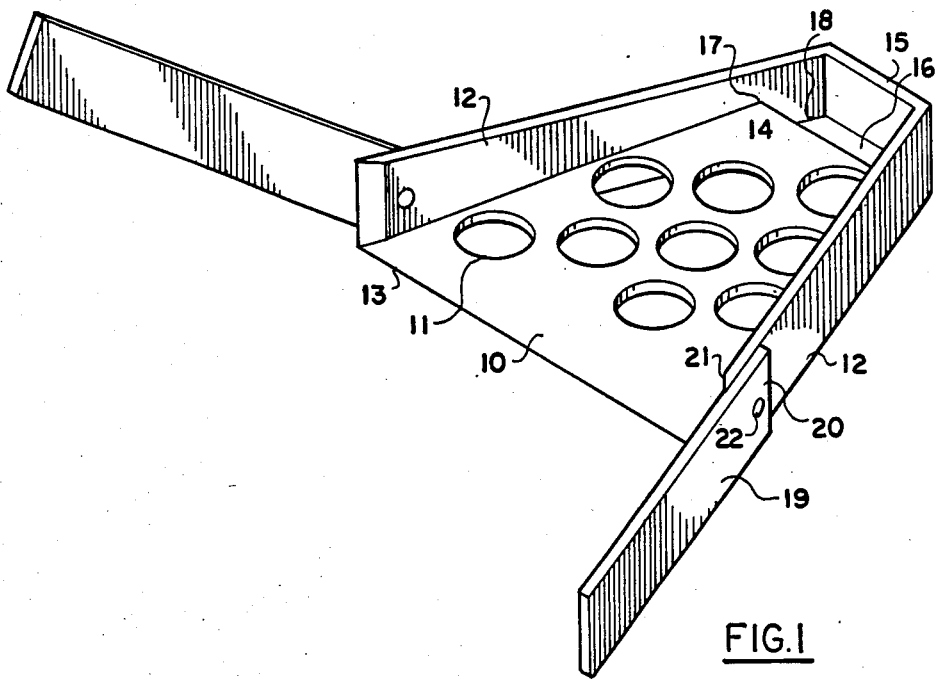
FIG. 1 is an isometric view of the ball receiver portion.

Proceeding therefore to describe the invention in detail, reference should first be made to FIG. 1 in which a planar board or ramp 10 is provided with a plurality of apertures 11 formed therethrough. A pair of side rails 12 are secured one to each side edge of the board 10 and, due to the shape of the board when viewed in plan, the side rails converge from the front edge 13 of the board towards the rear thereof and preferably extend beyond the rear edge 14 as clearly shown.

The rear end is closed off by cross rail 15 which extends between the rear ends of the side rails 12 thus defining an open front to the assembly and a rear recess 16 between the rear edge 14 of the board and the rear rail 15, the purpose of which will hereinafter become apparent.

Reference to FIG. 1 will also show that it is desirable that the board 10 slope upwardly from the front to the rear and it will be noted that the front edge is substantially flush with the under side edge of the side rails and gradually increases to a position indicated by reference character 17 which is spaced above the lower edge 18 of the rails.

Figure 2:
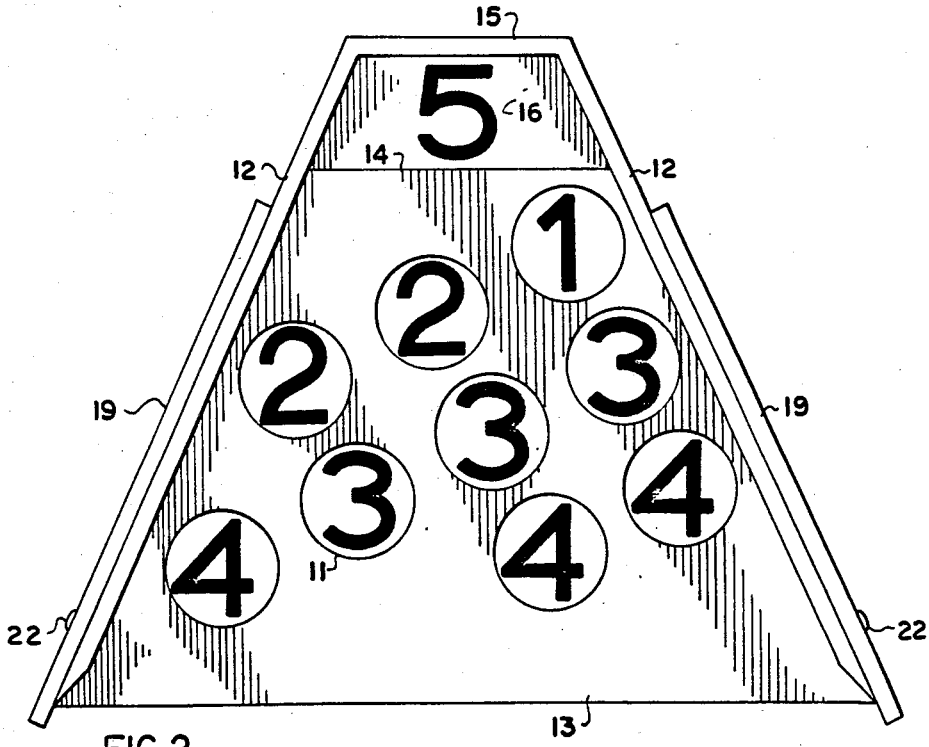
FIG. 2 is a plan view of FIG. 1 with the side rails in the folded or stored position and showing an insert carrying numerals.
Figure 3:
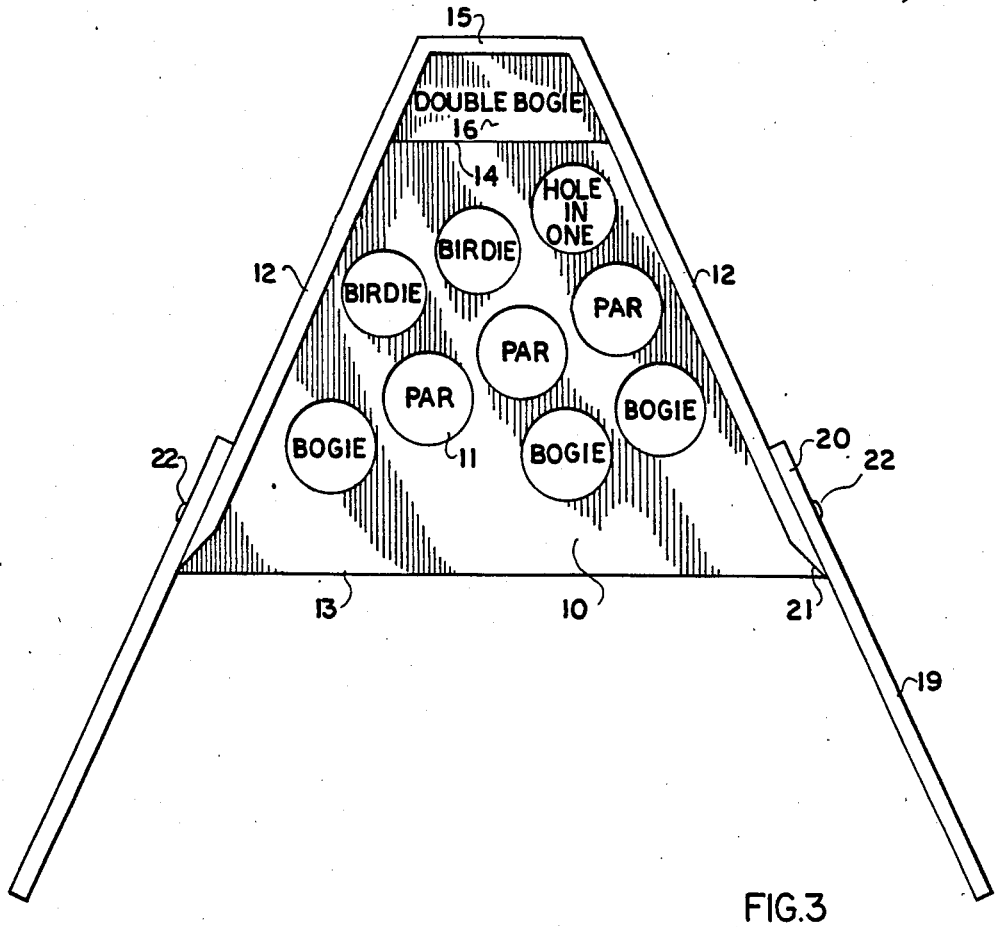
FIG. 3 is a plan view of FIG. 1 with the side rails extended and showing an insert indicating the results of various golf scores.
Figure 4:
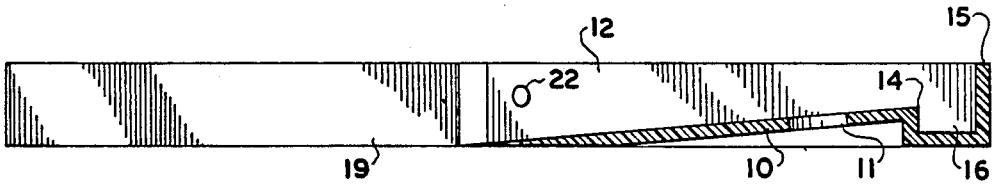
FIG. 4 is a longitudinal section of FIG. 3.

Side rail extensions 19 are pivoted adjacent the rear ends 20 thereof to adjacent the front ends 21 of the corresponding side rails 12, by means of pivot pins 22 so that when extended, they extend forwardly and outwardly as a continuation of the side rails 12 as clearly shown in FIGS. 1, 3 and 4 and, when they are folded to lie in a contiguous relationship to the side rails 12, are in the stored or transport position shown in FIG. 2.

A marker, not illustrated, is provided to act as a T-box which may be situated at any convenient location from the front of the device but preferably between 5 and 15 feet therefrom.

A conventional putter and golf ball is used and it is preferable that the putter be left and right handed. However as these are conventional, they have not been illustrated.

It will be noted that numerals are shown in the apertures in FIG. 2 and hole score terms are shown in the apertures in FIG. 3. These are meant to indicate paper or card inserts which are shaped similar to the configuration of the playing surface when viewed in plan and adapted to be slid underneath so that the words or numerals are visible. Alternatively, such cards may be propped up at one side of the game so that the players can readily identify the individual aperturesand circular holes.

Although other playing rules may of course exist, the following is a suggested set of rules.

A Value Card (not illustrated) may be provided which may indicate as follows.

Hole marked #1, is used for (a) "Hole in One" (can only be Scored on a Par 3 hole)

(b) "Eagle" (can only be Scored on a Par 4 hole)

(c) "Double Eagle" (can only be Scored on a Par 5 hole)

Holes marked #2

"Birdie" (can be Scored on Par 3, Par 4 and Par 5 holes)

Holes marked #3

"Par" (can be Scored on Par 3, Par 4 and Par 5 holes)

Holes marked #4

"Bogie" (can be Scored on Par 3, Par 4 and Par 5 Holes)

Holes marked #5

"Double Bogie" (can be Scored on Par 3, par 4 and Par 5 holes)

The rules of play are preferably as follows.

(1) Select a place to play where approximately 5 to 15 feet of putting surface is available.

(2) Place the Golf game board at one end of this area.

(3) Place the starting markers at the other end with enough space in between, for a person to putt.

(4) Place the VALUE CARD behind or beside the game board or underneath.

(5) Write the names of the players on the Score Cards. There is space for four names on the cards.

(6) Players take turns to putt the ball into one of the holes.

(7) Every player having started to putt, shall continue until the ball has entered into one of the nine holes or the slot.

(8) Enter the player's Score on the Score Card, adding the extra strokes taken, to the score on the Value Card.

EXAMPLE: USING A PAR 3 HOLE (1) If the ball goes into the "Hole in One" pocket on the first putt, the player's Score is 1: enter 1 on the Score Card. This person has scored a "Hole in One".

(2) If the ball goes into one of the "Birdie Holes" on the first putt, the player's Score is two (2)—Birdie meaning one stroke under Par: enter two (2) on the Score Card.

(3) If the ball goes into one of the "Par Holes" on the first putt, the player's Score is three (3): enter 3 on the Score Card.

(4) If the ball goes into one of the "Bogie Holes" on the first putt, the player's Score is four (4)—Bogie meaning one over Par: enter four (4) on the Score Card.

(5) If the ball goes into the "Double Bogie" slot on the first putt, the player's Score is five—"Double Bogie" meaning 2 over Par: enter five (5) on the Score Card.

Ball Not Entering a Hole on the First Putt

If the Ball does not reach the Playing Board on the first putt, the player keeps putting until the ball is holed out. All the extra strokes taken to hole the ball, are added to the Score.

EXAMPLE: ON A PAR 3 HOLE (1) If the ball goes into the "Hole in One" pocket the player has taken two extra putts, two extra strokes are added to the hole in one, giving a Score of 3—which is then Par for the hole.

EXAMPLE: ON A PAR 4 HOLE (2) If the ball goes into the "Hole in One" pocket and the player has taken two extra strokes, the Score for this hole will be Eagle plus two, giving a four (4) for the hole (Par 4).

EXAMPLE: ON A PAR 5 HOLE (3) If the ball goes into the "Hole in One" pocket and the player has taken two extra strokes, the Score for this hole will be Double Eagle plus 2, giving four (4) or Birdie for the hole.

If there are more than four players, it is best to have no more than four persons playing the game at one time: then on to the next group.

If there is a tie between the lowest Score, these players can plan extra holes to break the tie and declare a winner.

I claim:

1. A ball receiver for use in playing a game of carpet golf or the like on a substantially planar surface and comprising in combination a multi-apertured ramp board including a front edge, a rear edge and side edges, two front rows of apertures and a plurality of further apertures rearwardly thereof formed through said ramp board, a surrounding frame consisting of a side member along each side edge of the board defining an open front entrance to said board and means at the rear of said side members, spaced from the rear edge of said board, closing off the rear of the receiver, said side members and said means at the rear thereof extending above the plane of the board, and a rear recess at the rear of the board defined by the rear edge thereof, said side members and the means at the rear of the side members, said apertures being positioned so that the front two rows of apertures act as traps to the remaining apertures situated rearwardly of said front two rows thereby reducing the width of the path along which the ball may travel to reach said further apertures, forwardly extending side members each pivoted by one end thereof to adjacent the distal or front end of one of the side members and movable through approximately 180° in an arc in a vertical plane from a stored position whereby said extension side members lie substantially horizontally alongside the corresponding side member, to a playing position whereby said extending side members lie as forward extensions of said corresponding side members and in longitudinal alignment therewith, with the height of both the side members and the extension side members being substantially similar when in the playing position and the stored position.

2. The invention according to claim 1 in which said side members converge from the front of the side edges of the board towards the rear thereof.

* * * * *